US007067750B1

(12) United States Patent
Cantolino

(10) Patent No.: US 7,067,750 B1
(45) Date of Patent: Jun. 27, 2006

(54) FLOAT SWITCH AND MOUNTING SYSTEM ASSEMBLY

(76) Inventor: Christopher Ralph Cantolino, 2424 Manatee Ave., W., Suite 210, Bradenton, FL (US) 34205

( * ) Notice: Subject to any disclaimer, the term of this patent is extended or adjusted under 35 U.S.C. 154(b) by 0 days.

(21) Appl. No.: 11/274,604

(22) Filed: Nov. 15, 2005

Related U.S. Application Data

(63) Continuation-in-part of application No. 11/124,952, filed on May 9, 2005, now Pat. No. 6,992,260, which is a continuation-in-part of application No. 10/932, 967, filed on Sep. 2, 2004.

(51) Int. Cl.
*H01H 35/18* (2006.01)

(52) U.S. Cl. ..... 200/84 R

(58) Field of Classification Search ..... 73/305–309, 73/317–322.5; 200/84 R–84 C, 293; 338/33; 340/618–625
See application file for complete search history.

(56) References Cited

U.S. PATENT DOCUMENTS 3,176,707 A * 4/1965 Wilson ..... 73/322.5
4,183,176 A * 1/1980 Barfield ..... 73/317
4,345,879 A * 8/1982 Steiner ..... 200/84 C
4,757,305 A * 7/1988 Peso ..... 200/84 C
4,833,441 A * 5/1989 Okada et al. ..... 200/84 C
5,862,702 A * 1/1999 Liang ..... 200/84 C
6,513,378 B1 * 2/2003 Love, Jr. ..... 73/313
6,530,274 B1 * 3/2003 Philbeck ..... 73/314
6,681,627 B1 * 1/2004 Li ..... 200/84 C
6,730,865 B1 * 5/2004 Hernandez-Zelaya ..... 200/84 R
6,992,260 B1 * 1/2006 Cantolino ..... 200/84 R

* cited by examiner

*Primary Examiner*—Michael A. Friedhofer
(74) *Attorney, Agent, or Firm*—Dorothy S. Morse

(57) ABSTRACT

A float switch assembly with a housing/clamping structure that is made from plastic and impervious to corrosion, with improvements over the prior art including a thumbscrew positioned between its two upper bracing protrusions and external braces/ribs that make it less likely for the two parts of the housing to flex relative to one another, to provide a more secure connection between the two parts of the present housing during its use to protect a float switch body within its protective housing for reliable shut-off signal activation when needed. The two housing parts are connected together over the top edge of a substantially vertically-extending support surface, such as a plastic condensate collection pan with a flange. Oversized thumbscrews facilitate and expedite installation without drilling any holes in the collection pan.

20 Claims, 12 Drawing Sheets

FLOAT SWITCH AND MOUNTING SYSTEM ASSEMBLY

CROSS-REFERENCES TO RELATED APPLICATIONS

This application is a continuation-in-part of the still pending U.S. Ser. No. 11/124,952 now U.S. Pat. No. 6,992,260 filed by the same inventor for overlapping subject matter on May 5, 2005, which is a further continuation-in-part of U.S. Ser. No. 10/932,967 filed by the same inventor on Sep. 2, 2004, with improvements over the inventions disclosed in the inventor's two parent applications primarily including the addition of a thumbscrew between the two laterally positioned upper bracing members that helps to maintain the two parts of the housing/clamp structure in close association with one another when placed on the upper edge of a plastic or metal condensate collection pan in all surroundings, including those subject to wide temperature fluctuations. The additional thumbscrew allows for quick separation of the two-part housing/clamp structure prior to installation, which can take as little as ten seconds. Another improvement is the addition of external support braces, internal ribs, and wings which add strength to the housing and minimize flexing of the two protective float housing parts relative to one another so as to help maintain the float switch body in a level orientation during its use for a prompt and reliable system shut-off response to rising levels of collected condensate beyond a pre-determined safe threshold amount. Also, similar to its parent application, the present invention further has its air vent hole or holes through the rear wall of the protective housing in the first part of the two-part housing/clamp structure that is configured to safeguard the float switch body, instead of having one or more air vent holes through the top surface of the protective housing. The protected vent holes are less likely to become clogged with water, algae, and/or debris than top surface vent holes, further providing enhanced speed and reliability in system shut-off response.

BACKGROUND OF THE INVENTION

1. Field of the Invention

This invention relates to liquid-level float switches, specifically to a float switch and mounting system assembly of sturdy construction that is primarily contemplated for use in air conditioning condensate collection/overflow applications, or other applications where rising fluid beyond a threshold limit is undesirable and automated shut-off of the fluid source is needed to eliminate the risk of overflow and property damage. Currently used air conditioning condensate collection pans have many different upper edge configurations, thickness dimensions, and are made from a variety of plastic and metal materials. This has caused installers and repairmen to maintain a supply of at least several different float switch mounting systems, some adapting better to the thinner upper edge of metal condensate collection pans, and others more suited to the variable thicknesses found in existing plastic condensate collection pans. The location of the condensate collection pan also affects the type of shut-off switch used, as an attic environment can be subject to very high and very low temperature extremes. The goal of the present invention switch is provide one shut-off switch that can be quickly installed and is adaptable to all types and styles of currently existing condensate collection pans in air conditioning applications, including those with a thicker upper edge configuration and those with a slightly flared upper edge configuration. Further, since air conditioning condensate collection pans are often installed in hot attics, and other places where significant temperature fluctuations can occur, and also since many plastic condensate collection pans have insufficient construction whereby a float switch mounted on its upper edge will lean in over a period of time and no longer maintain the vertical orientation of shut-off switches mounted thereon that is needed for prompt and reliable switch operation, the present invention is also configured with an upper thumbscrew and external braces, internal ribs, and wings which strengthen the housing and minimize flexing to overcome the lean in problem. The most preferred embodiment of the present invention comprises an adjustable float switch body with the amount of its vertical movement relative to a concentrically positioned shaft being adjustably defined by an upper lock-nut connected to the threaded upper portion of the shaft upon which the float switch body moves, with the float switch body also having a large surface area for enhanced buoyancy and responsive operation. In addition, the most preferred embodiment of the present invention has a housing configured and positioned to protect float switch body movement from interference due to airborne debris, with the housing being closely positioned around the float switch body and having an open bottom end, the housing also having a threaded aperture centrally through its top surface that is configured for aligning the upper end of the shaft as it guides the vertical displacement of the float switch body within the housing, and the float housing further having at least one air vent opening through its rear wall (instead of through its top surface) that is configured and dimensioned to prevent float switch body malfunction as a result of an airlock created by fluid entering the float housing through its open bottom end. Further, the two-part housing/clamp structure of the most preferred embodiment of the present invention creates an inverted J-shaped slot configured for being positioned over the upper edge of a vertically-extending support surface, such as the upstanding wall of a plastic pan, with the back wall of the float housing (on the front part of the housing/clamp structure) forming one side of the slot and interior wall of the rear part of the housing/clamp structure forming the remaining part of the J-shaped slot, the rear part of the housing/clamp structure also preferably having at least two horizontally-extending lower threaded bores therethrough each configured for the engagement of one thumbscrew used for tightening the housing/clamp structure against a vertically-extending support surface positioned within its J-shaped slot for a secure connection of the two-part housing/clamp structure to its support surface and stabilization of the installed housing/clamp structure to prevent changes in its orientation that could diminish float switch body function. Vertically-extending internal ribs on both parts of the housing/clamp structure, in combination with the air vent holes in the rear wall/surface of the float housing, further assist in preventing airlock as fluid in the float housing rises prior to shut-off signal activation.

2. Description of the Related Art

When air conditioning condensate and other condensates are collected, there is often a risk of overflow and/or back-up into the system producing it. As a result, liquid-level float switches have been employed with collection pans to shut-off the source of condensate flow when the amount of fluid collected exceeds a predetermined depth considered safe in avoiding back-up or overflow. However, currently known float switches are deficient in many ways and thereby subject to malfunction, less responsive operation, more costly installation, and/or unstable installation. First, the collection pans used for condensate collection do not always have a sturdy construction. Therefore, when the upstanding pan wall to which a float switch is attached bends as a result of the added weight of the mounted switch, the pan wall tends to lean in over time and when it does the float switch body no longer maintains a level orientation, making it less responsive. Also, the plastic pans used in condensate collection applications can have varying upper edge configurations and a mounting bracket that securely attaches a switch/housing to a specific style of condensate pan so as to achieve proper float switch function, may not be able to become securely attached to a pan with a different upper edge thickness or configuration. This requires added expense for installers and repairmen when they must maintain a supply of at least several different float switch mounting systems, some adapting better to the thinner upper edge of metal condensate collection pans, and others more suited to the variable thicknesses found in existing plastic condensate collection pans. Further, depending upon the location of the collection pan, a float switch mounted thereto may be at risk for malfunction as a result of airborne debris, such as but not limited to the insulation fibers often encountered in attics where air conditioning system condensing units are commonly installed. Also, prior art liquid-level float switches tend to have float switch bodies that wobble relative to the shaft with which they are associated, a condition that can lead to less responsive operation or malfunction. Typically also, the installation of prior art float switches requires the drilling of at least one hole through the support surface or pan, which increases installation cost. In addition, some float switches are at risk for premature malfunction as a result of being made from materials that are not completely corrosion-resistant. In contrast, the present invention is made from plastic that is impervious to corrosion and pest-resistant. Its float switch body is wider than those of known prior art float switches for greater water displacement and a faster response, and it contains a housing that protects its float switch body from malfunction due to airborne debris. In addition, it has at least three thumbscrews to facilitate and expedite clamping member installation in as little as ten seconds, much faster than the prior art switch installation requiring the drilling of a hole in the condensate pan collection wall. Present invention thumbscrews additionally provide adjustability for better installation involving plastic pans. Further, a plurality of spaced-apart, vertically-extending internal ribs add strength to the present invention housing/clamp structure as well as provide air venting spaces therebetween to assist in preventing airlock as fluid rises within the float housing, external braces/ribs and lateral wings also add strength to prevent present invention flexing that could lead to lean in problems, and relocation of air vent holes from the top surface of the protective float housing to the back wall/surface of the protective float housing, which is in the front part of the housing/clamp structure, in combination with the vertically-extending, spaced-apart internal ribs that have venting spaces therebetween, protects the vent holes from airlock and makes them less likely to clog with water, algae, and/or debris for continued proper deployment of the float switch body within the housing during extended periods of use.

BRIEF SUMMARY OF THE INVENTION—OBJECTIVES AND ADVANTAGES

The primary object of the present invention is to provide a float switch and mounting system assembly for use with plastic condensate collection pans to shut-off condensate flow when the amount of fluid collected in the associated pan exceeds a predetermined safe threshold depth. A further object of the present invention is to provide a float switch and mounting system assembly that is adjustable in its connection to the vertically-extending wall of a fluid collection pan so that it can be used with a variety of pans having differing wall thickness dimensions and upper edge configurations whereby installers do not incur the added expense of having to carry multiple switches for differing applications. It is a further object of the present invention to provide a float switch that is sturdy in construction for responsive and reliable operation during extended periods of use. It is also an object of the present invention to provide a float switch and mounting system assembly that has cost-effective construction for widespread distribution and use. A further object of the present invention is to provide a float switch and mounting system assembly designed for prompt, easy, and cost-effective installation. It is also an object of the present invention to provide a float switch and mounting system assembly that is adjustable and capable of being securely installed and thereafter remain substantially in its original orientation during its entire period of use. Another object of the present invention is to provide a float switch and mounting system assembly with a design that compensates for insubstantial condensate collection pan construction, to prevent the float switch body and associated pan wall from leaning in during present invention use. A further object of this invention is to provide a float switch and mounting system assembly that has a means of self-protection against malfunction due to airborne debris, including loose insulation fibers that are likely to be present in attic installations. In addition, it is a further object of the present invention to provide a float switch and mounting system assembly that is made from pest-resistant and corrosion-resistant materials that resist premature deterioration and malfunction.

As described herein, properly manufactured and used, the present invention would provide a float switch and mounting system assembly that can be used to shut-off the flow of condensate or other fluid when the amount of it collected in a pan or other container associated with the present invention reaches a pre-determined safe maximum/threshold depth. The present invention is typically made from pest-resistant plastic, and is thereby impervious to corrosion, which in combination with its sturdy construction avoids premature deterioration. Also, its float switch body is wider than prior art float switches for greater water displacement, and its housing contains a rear vent hole configuration that protects its float switch body from malfunction due to vent hole clogging by airborne debris, both of which contribute to a more responsive and reliable float body deployment than can be achieved with prior art shut-off switches employed in condensate pan applications. In addition, the present invention has a two-part housing/clamp structure with an inverted J-shaped slot and preferably at least three thumbscrews that facilitate and expedite installation, making it possible to install the present invention in as little as ten seconds. The adjustable connection provided by the thumbscrews gives the present invention versatility in being able to be used with condensate pans having a wide variety of configurations and wall thickness dimensions. Also, since the amount of vertical float switch body displacement is adjustable, the present invention is readily adaptable to a wide variety of applications and changing needs. Further, the thumbscrews prevent the need for drilling holes in a condensate pan wall or other support structure, making installation of the present invention fast, efficient, and cost-effective. Sturdy and cost-effective construction is derived from molded manufacture and the external braces/ribs on the front part of the housing/clamp structure, the lateral wings on the rear part of the housing/clamp structure, and the multiple spaced-apart, vertically-extending internal ribs in both front and rear parts of the housing/clamp structure. In addition, installation of the present invention via its inverted J-shaped slot and thumbscrews provides for secure connection of the present invention to support surfaces of varying configuration and construction, even when the support surface is uneven or of varying thickness, with the wide J-shaped slot and external braces/ribs compensating for weak condensate collection pan construction so as to prevent the float switch body from leaning in during use and potentially becoming less responsive during extended use. A quick release of the top thumbscrew allows prompt separation of the front and rear parts of the two-part housing/clamp structure. Then, once the front and rear parts are positioned on opposing sides of a vertically-extending support wall, with the front part of the housing/clamp structure (containing the protective float housing) against the interior surface of the support wall and the rear part of the housing/clamp structure (carrying the thumbscrews) against the exterior surface of the support wall, a simple tightening of the three or more thumbscrews securely connects the housing/clamp structure in a desirable position of use. The protective housing shields the vertically deployable float switch body against malfunction due to interference from airborne debris, such as but not limited to the potential interference from loose insulation fibers in air conditioning related attic installations. Further, placement of the air hole or holes through the protected rear wall of the front part of the housing/clamp structure makes them less likely to become clogged during use, which facilitates and promotes reliable float switch body movement by preventing airlock.

Although the description herein provides preferred embodiments of the present invention, it should not be construed as limiting the scope of the present invention float switch and mounting system assembly. For example, variations in the height and diameter dimension of the shaft used for float switch body movement; the number of threads used on the upper portion of the shaft for engagement with the threaded top opening in the float housing; the size, number, configuration, and spaced-apart location of the air vent openings in the back wall of the protective float housing that is incorporated into the front part of the housing/clamp structure; the size, location, number, and spaced-apart location of the lower thumbscrew openings in the rear part of the housing/clamp structure; the depth and width of the upwardly-extending J-shaped slot; the number, location, configuration, and relative spacing of the internal ribs and external braces/ribs; the relative height dimensions of the float switch body, float housing, and shaft although the shaft may extend below the float housing; the configuration and dimension of the float housing as long as it allows for unrestricted vertical float switch body movement without unnecessary material expense and is not too big to permit float switch body wobble during its deployment; and the perimeter configuration and dimension of the lock-nuts used to tighten the shaft within the top opening of the float housing and adjustment of the height of float switch body deployment; in addition to those variations shown and described herein, may be incorporated into the present invention. Thus, the scope of the present invention should be determined by the appended claims and their legal equivalents, rather than being limited to the examples given.

DETAILED DESCRIPTION OF THE INVENTION

While FIGS. 1–12 show the most preferred embodiment of the present invention, it is to be understood that many variations in the present invention are possible and also considered to be a part of the invention disclosed herein, even though such variations are not specifically mentioned or shown. As a result, a reader should determine the scope of the present invention by the appended claims.

Figure 1:
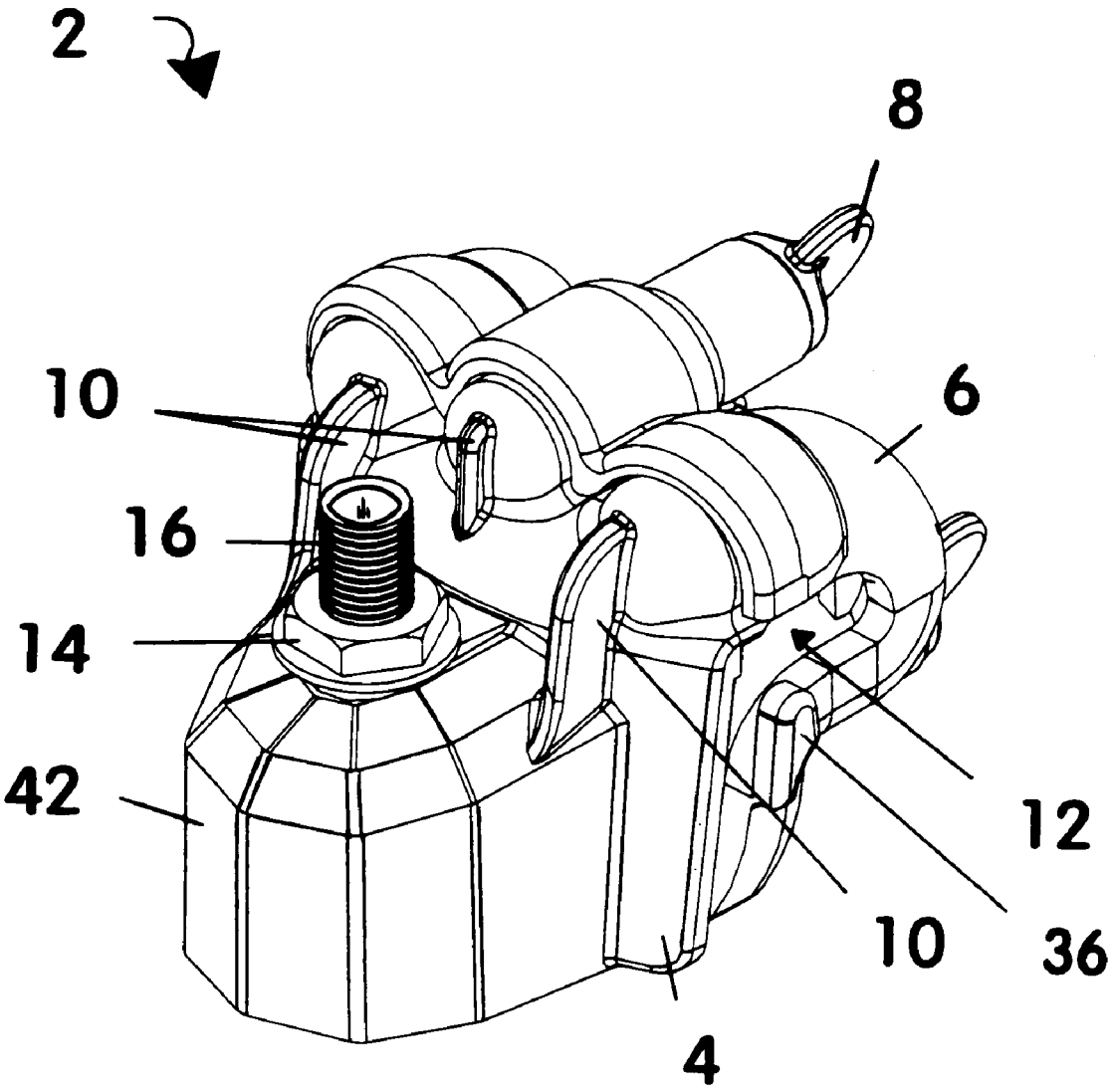
FIG. 1 is a front perspective front view of the most preferred embodiment of the present invention having a two-part housing/clamp structure adapted for attachment to a vertically-extending support surface, such as the upper edge of a plastic condensate pan, with the rear part of the housing/clamp structure having an upper thumbscrew extending therethrough for promptly connecting and disconnecting the two parts of the housing/clamp structure from one another, as well as multiple lower thumbscrews therethrough which directly engage the outside surface of the support surface or condensate pan.

FIG. 1 shows the most preferred embodiment 2 of the present invention having a two-part housing/clamp structure adapted for attachment to a substantially vertically-extending support surface (not shown), such as but not limited to a plastic condensate collection pan used in air conditioning applications. FIG. 1 shows front part 4 and rear part 6 of most preferred embodiment 2 joined together as they would be during use. Inverted J-shaped slot 12 is where the upper edge of a condensate collection pan wall or other support surface (not shown) would be inserted and firmly secured via multiple fasteners, preferably thumbscrews with oversized heads. FIG. 1 shows an upper thumbscrew 8 being used to securely attach front part 4 to rear part 6 centrally above inverted J-shaped slot 12, while lower thumbscrews 8 (preferably two, but more than two are also considered to be within the scope of the present invention) are shown inserted through threaded openings 40 in rear part 6 where they are tightened against the vertically-extending support surface to bias it firmly against front part 4. During routine use, it is contemplated for the distal ends of the lower fastener/thumbscrews 8 (hereinafter thumbscrews 8) to be in contact with the exterior portion of the vertically-extending support surface, not rear part 6. While the length dimensions of thumbscrews 8 and the configurations of its opposing ends may vary from that shown in FIGS. 1 and 3–7, it is preferred for thumbscrews 8 to be sufficient in length for biasing the thinnest support surface contemplated for use with most preferred embodiment 2 firmly against front part 4. It is further preferred that the biasing end of each thumbscrew 8 has a substantially flat configuration to maximize the amount of contact area between it and the support surface for non-slip biasing purposes, and it is also preferred for the configuration of the end of each thumbscrew 8 extending beyond rear part 6 during use to be sufficiently oversized for easy and convenient hand manipulation by installers and maintenance personnel. In addition, the configuration of inverted J-shaped slot 12, while remaining substantially J-shaped, may have some dimensional variation from that shown in FIGS. 1, 4, and 5 as long as the dimension and configuration of slot 12 accommodates various thicknesses and styles of condensate collection pan walls currently used in air conditioning applications, while at the same time providing a close and secure connection of front part 4 and rear part 6 over the top edge of the associated condensate collection pan wall or other support surface.

Figure 3:
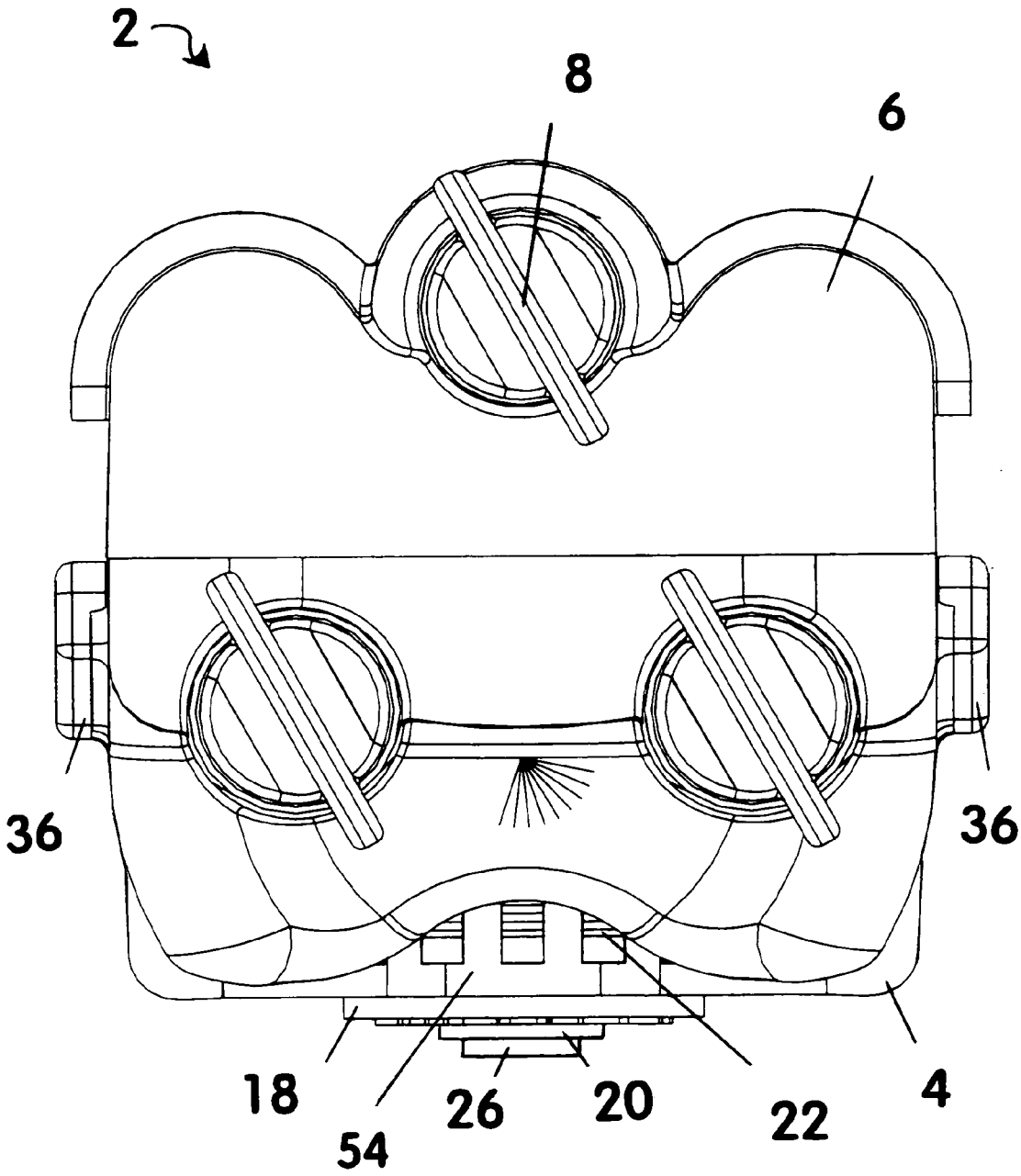
FIG. 3 is back view of the two-part housing/clamp structure in the most preferred embodiment of the present invention having a rear part with two lower thumbscrews and one upper thumbscrew extending therethrough in a substantially horizontally-extending orientation, with several vertically-extending ribs each having a ridged distal surface visible on the rearwardly facing surface of the front part of the housing/clamp structure, and a disk-shaped stop/clip as well as the bottommost portions of a shaft and float switch body visible in a position extending below the front part of the housing/clamp structure.
Figure 7:
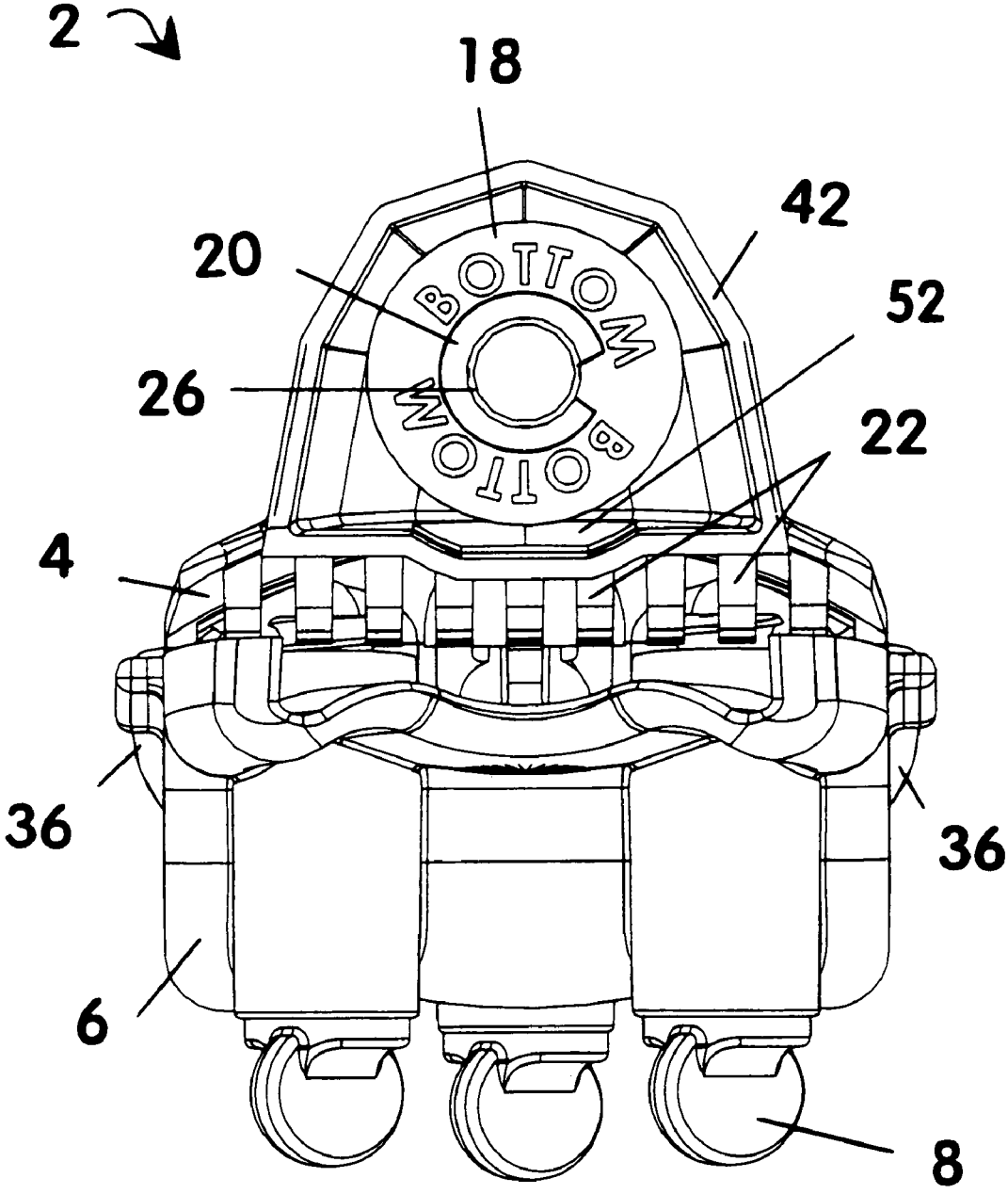
FIG. 7 is a bottom view of the most preferred embodiment of the present invention with the front and rear parts of the two-part housing/clamp structure connected to one another, three thumbscrews, and the float switch body and shaft, all in their usable positions, and multiple vertically-extending internal ribs visible on the interior surface of the front part of the housing/clamp structure, with each having a ridged distal surface providing gripping and air venting means, and also forming part of the perimeter of the inverted J-shaped slot.
Figure 8:
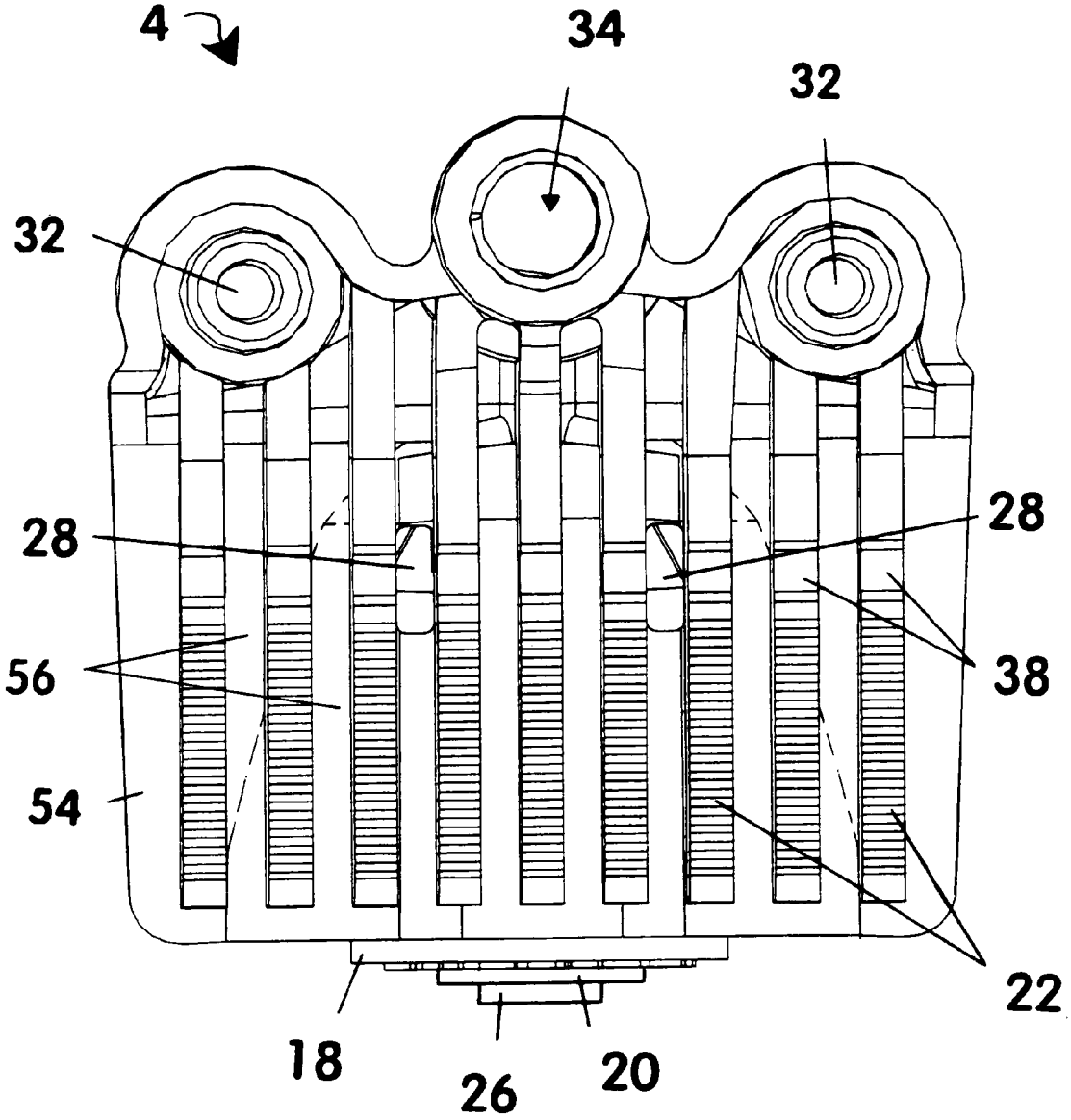
FIG. 8 is a back view of the front part of the two-part housing/clamp structure with multiple vertically-extending ribs each having a notch at approximately the same height to form an air venting channel, each rib also having a ridged distal surface below the notch, two air vent openings through the back wall of the float housing between ribs and in fluid communication with the notches forming the air venting channel, a central threaded opening for engagement with the upper thumbscrew, and two spaced-apart lateral bracing protrusions positioned whereby one protrusion is located on each side of the threaded opening.
Figure 9:
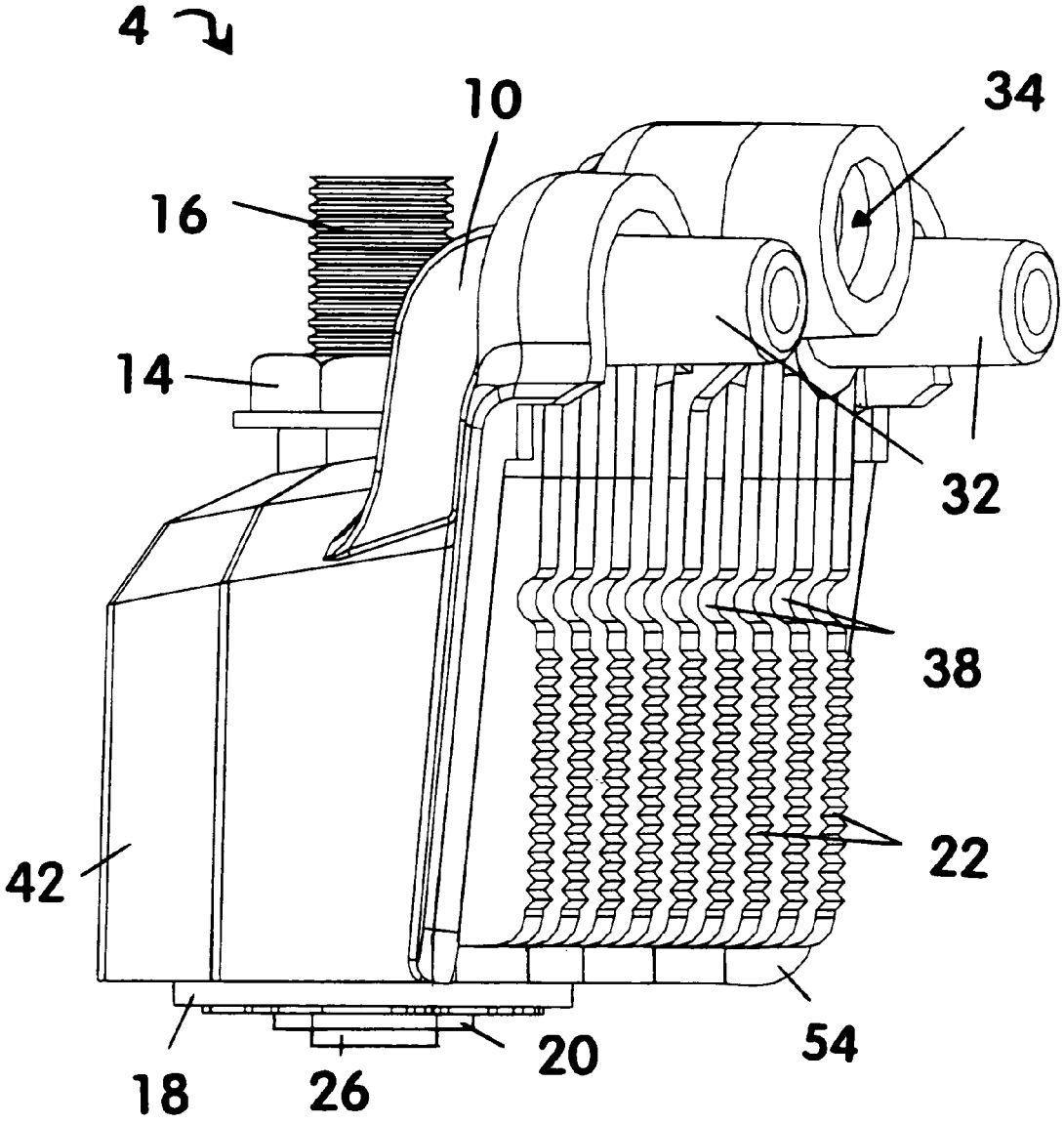
FIG. 9 is a rear perspective view of the front part of the two-part housing/clamp structure in the most preferred embodiment of the present invention having a shaft extending through the protective float housing, multiple closely spaced-apart and vertically extending ribs each with a notch and a ridged distal surface, a central threaded opening for securing the upper thumbscrew, and two spaced-apart bracing protrusions for strengthening the connection between the front and rear parts of the housing/clamp structure, with each protrusion laterally positioned on a different side of the central threaded opening.
Figure 12:
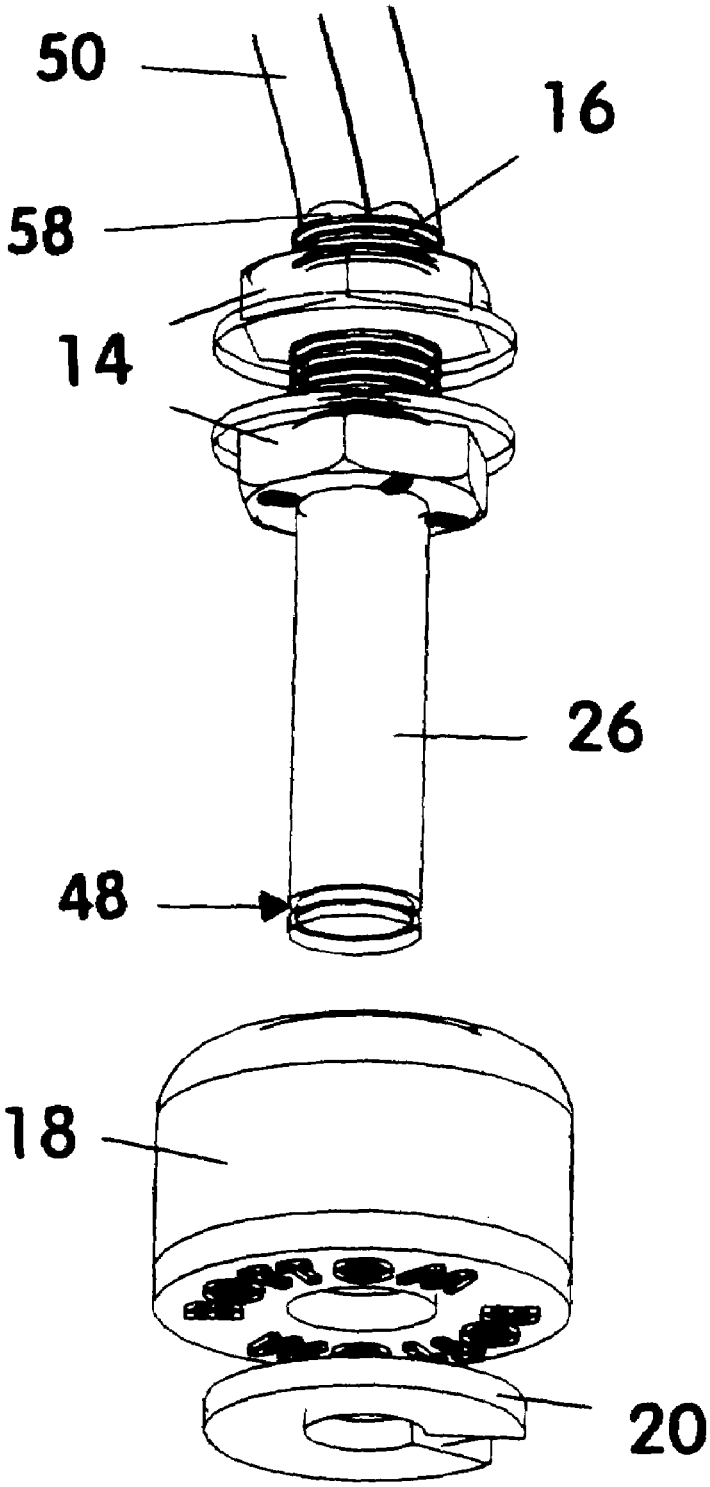
FIG. 12 is a side view of the float switch assembly in the most preferred embodiment of the present invention having a float body that is guided in vertical movement by a shaft, a clip and lock-nut that together define the amount of float body movement, and a second lock-nut for securing the shaft through the opening in the top surface of the protective housing.

FIG. 1 also shows front part 4 having a protective housing 42 for the float switch body 18 shown in FIG. 12, and several external braces/ribs 10 upwardly depending from the top surface of protective housing 42. Protective housing 42 extends outwardly from front part 4 in a direction remote from the heads of thumbscrews 8. FIG. 1 shows all braces/ribs 10 in a substantially vertically-extending in orientation, which is preferred, with two braces/ribs 10 being laterally positioned and a third smaller brace/rib 10 centrally positioned between the other two. Although a three brace/rib 10 configuration is preferred, more than three braces/ribs 10 can be used and the configuration of each can be varied from that shown as long as they fulfill they intended function without being so numerous or large as to create material waste. Braces/ribs 10 add strength to front part 4 and minimize flexing of front part 4 relative to rear part 6 during use, so as to help maintain the float switch body 18 within protective housing 42 in a level orientation during its vertical deployment for a prompt and reliable system shut-off response to rising levels of collected condensate beyond an established safe threshold amount. Although FIG. 1 shows the height dimension of protective housing 42 as being sufficient to completely cover the float switch body 18 positioned within it, the height dimension of protective housing 42 is not critical and can be greater or less than that shown in FIG. 1, as long as protective housing 42 is sufficiently large to fulfill its primary function of protecting float switch body 18 from malfunction due to interference by airborne and other debris (not shown). Also, in furtherance of that protective function, protective housing 42 has a substantially half-dodecagon shape with a sloping top surface that helps to prevent the accumulation of debris thereon. The half-dodecagon shape of protective housing 42 adds strength to permit thinner wall construction and less material cost than would be needed for a half-cylindrical protective housing 42 of similar size. Although air vent openings 28 are not visible in FIG. 1, as shown in FIGS. 3, 8, and 9 at least one air vent opening 28 is used through the rear surface 54 of front part 4 to prevent airlock and possible malfunction of float switch body 18 as rising water moves upwardly into protective housing 42 through its open bottom end. The size, number, positioning, and configuration of air vent openings 28 can vary from that shown in FIG. 8, although air vent openings would need to be in a raised position to prevent such airlock and a simple air vent opening 28 may be larger than illustrated herein. Further, although it is not visible in FIG. 1, the open bottom end of protective housing 42 can be seen in FIG. 7, with FIG. 7 also showing float switch body 18 substantially filling protective housing 42. FIG. 7 further shows float switch body 18 positioned concentrically around a shaft 26, the threaded upper end 16 of which is shown in FIG. 1 extending centrally through the top surface of protective housing 42. In addition, FIG. 7 shows a clip 20 preventing float switch body from becoming separated from the lower end of shaft 26. Two lock-nuts 14, which are shown in FIG. 12, secure the threaded upper end 16 of shaft 26 in its usable position relative to protective housing 42. The lower lock-nut 14 that is hidden from view within protective housing 42 in FIG. 1, further helps to tighten shaft 26 in its usable and substantially vertically-extending position within protective housing 42. Shaft 26 guides the vertical movement of float switch body 18 between the lower lock-nut 14 that is positioned within protective housing 42 and a disk-shaped stop or clip 20 (also shown in FIG. 12) secured in a groove 48 on the non-threaded lower portion of shaft 26. The movement of float switch body 18 is in direct response to the changing depth of fluid within protective housing 42, which enters the open bottom end of protective housing 42 as it accumulates in a condensate collection pan or other support container that has its top edge secured between front part 4 and rear part 6 of most preferred embodiment 2, with a signal to shut off fluid production being sent when the depth of fluid within protective housing 42 reaches a threshold level no longer considered to be safe, wherein damage to the fluid producing unit or other property (not shown) is at risk from back-up or overflow of the collected fluid. Further, although not shown in FIG. 1 for clarity of illustration in revealing the structure of front part 4 and rear part 6, but shown in FIGS. 5 and 12, the upper threaded portion 16 of shaft 26 would be hollow at least in part and have a top opening 24 (shown in FIG. 5). When electrical wiring 50 (shown in FIG. 12) is connected into the circuit of the fluid generating system (not shown) and causes fluid to rise within protective housing 42, it is preferred for electrical wiring 50 to extend through top opening 24. Thus, when collected fluid rises within protective housing 42, float switch body 18 will rise accordingly, and when the depth of the fluid within protective housing 42 reaches a pre-determined threshold height no longer considered safe, the system's circuit will either be interrupted or completed so as to stop the generation of additional fluid. Sealant 51, shown in FIG. 12 and typically having a water-resistant composition, is also preferred for securing electrical wiring 50 within the upper threaded portion 16 of shaft 26 to protect and hold fast the connection between electrical wiring 50 and most preferred embodiment 2 when it is handled during installation and maintenance.

Figure 2:
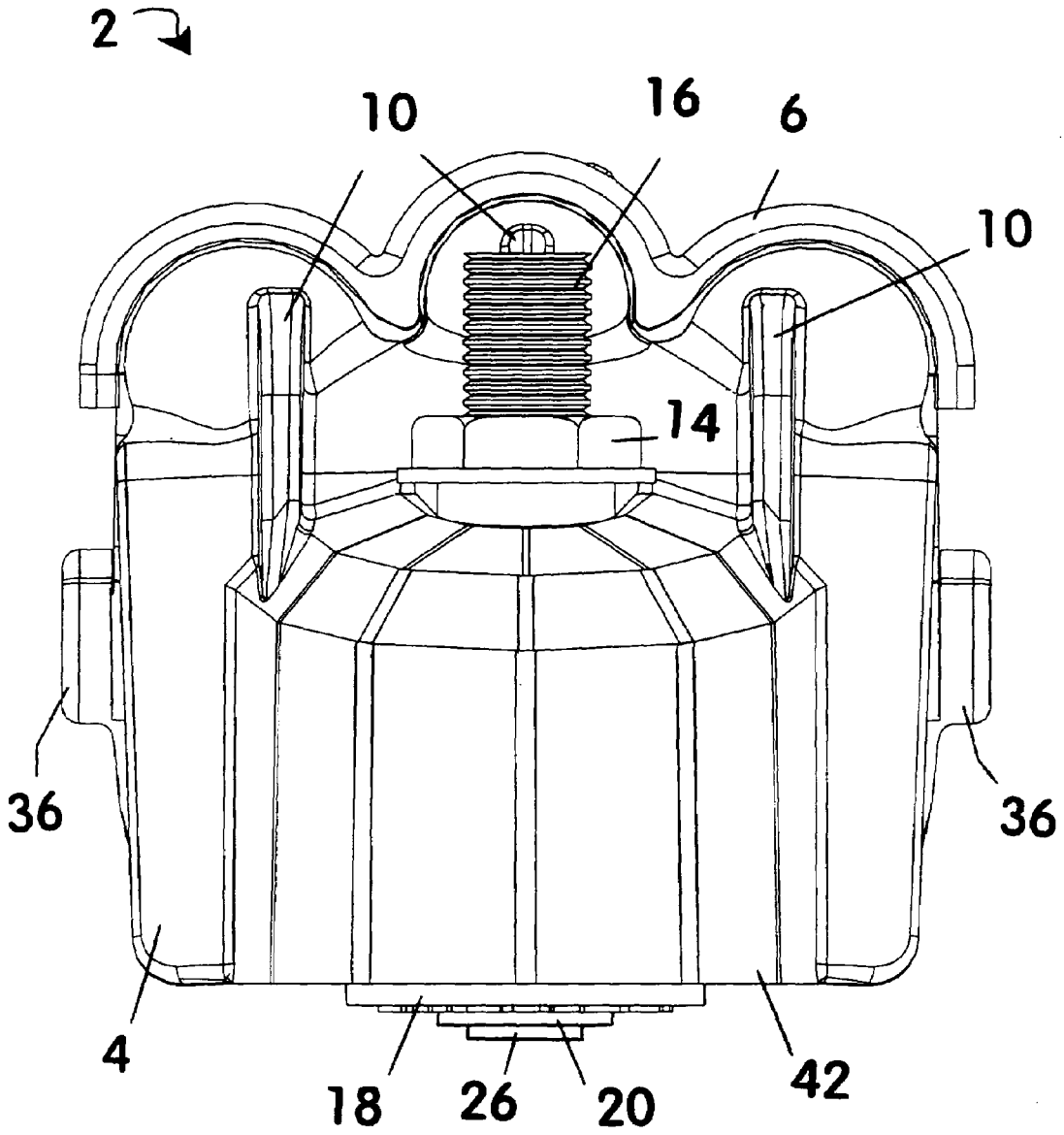
FIG. 2 is front view of the most preferred embodiment of the present invention having a two-part housing/clamp structure with a float body guiding shaft secured centrally through a top opening in the half-dodecagon shaped float housing and two spaced-apart external braces/ribs vertically extending from the top portion of the half-dodecagon shaped float housing, with the front part of the housing/clamp structure contemplated for engaging the inside surface of a condensate pan or other support wall, reinforcing wings laterally on the rear part of the housing clamp structure, and a smaller brace/rib present centrally between the two laterally positioned and larger external braces/ribs.

FIG. 1 further shows front part and rear part 6 having a height dimension greater than that of protective housing 42, with the surplus height extending upwardly beyond the sloping top surface of protective housing 42 and accommodating connections for upper thumbscrew 8 and bracing protrusions 32, which are hidden in FIG. 1 but visible in FIGS. 8 and 9. In addition, with the exception of wings 36, the width dimension of rear part 6 is substantially similar to that of front part 4. However, the respective width and height dimensions of rear part 6 and front part 4 are not critical, and either could be greater or less than that shown in FIG. 1 as long as they provide a sturdy connection to one another over the top edge of a condensate collection pan wall or other support surface or container (not shown). The configuration and dimension of rear part 6 is substantially determined by factors that include but are not limited to the reduction of material cost, cost-effective manufacture, assisting the prevention of airlock as water rises within protective housing 42, and reducing the amount of flexing between front part 4 and rear part 6 when they are joined together for use. FIG. 1 further shows one of two lateral wings 36 adjacent to the inverted J-shaped slot 12 that provide additional reinforcement to rear part 6 for reduced flexing that helps to maintain float switch body 18 in a needed level orientation for proper and reliable deployment. Although only one is shown in FIG. 1, it is contemplated for rear part 6 in most preferred embodiment 2 to have a lateral wing 36 in a similar location on its hidden side, as shown in FIG. 2. As seen in other illustrations (including FIGS. 9 and 10), rear part 6 also has at least two lower threaded openings 40 for thumbscrews 8, two upper receptacles 30 to accommodate the rearwardly-extending bracing protrusions 32 of front part 4, and a pass-through opening 46 between upper receptacles 30 through which the upper thumbscrew 8 that connects front part 4 to rear part 6 can be easily and promptly inserted. However, pass-through opening 46 should not be so large relative to thumbscrews 8 as to create a wobbly and/or otherwise unstable connection between front part 4 and rear part 6.

FIG. 2 shows the most preferred embodiment 2 of the present invention having a two-part housing/clamp structure with a front part 4 and a rear part 6 joined together, with rear part 6 positioned directly behind front part 4 and little visible except its wings 36 and its top perimeter that is above the pass-through opening 46 and the receptacles 30 each used for engagement with one of the laterally positioned bracing protrusions 32 of front part 4. It is contemplated for the front part 4 of the housing/clamp structure to be in contact with the inside wall surface of a condensate pan or other vertically-extending support surface (not shown), and for the ends of the thumbscrews 8 that are remote from the oversized heads to contact with the opposed outside wall surface of the condensate pan or other support surface and bias it against front part 4. During routine use of preferred embodiment 2, rear part 6 does not touch the vertically-extending part of a condensate pan or other support surface. In addition, FIG. 2 shows the upper threaded portion 16 of shaft 26 secured in place via a lock-nut 14 centrally through a top opening in a half-dodecagon shaped protective housing 42. Although not visible in FIG. 2, a second lock-nut 14 (shown in FIG. 12) is positioned within protective housing 42 and used in combination with the externally positioned second lock-nut 14 to fix shaft 26 in its usable position relative to protective housing 42. Upper threaded portion 16 substantially blocks an observer's view of a small centrally located external brace/rib 10 upwardly depending from protective housing 42. FIG. 2 shows two spaced-apart and laterally positioned external braces/ribs 10 vertically depending from the top sloped surface of protective housing 42. Although three brace/ribs 10 and the size and configuration shown in FIG. 2 are preferred, the number, size, and configuration of braces/ribs 10 can differ from that shown. Slightly below protective housing 42, FIG. 2 shows float switch body 18, shaft 26, and clip 20. While the height of protective housing 42 is not critical, it should be sufficiently tall to protect float switch body 18 from interfering debris (not shown) that could prevent prompt deployment of float switch body 18 when it is needed to shut off fluid generation. Although not shown in FIG. 2, shaft 26 preferably has a hollow top opening (shown in FIG. 5 by the number 24) that allows electrical wiring 50 to extend therethrough for connection to the fluid generating system associated with preferred embodiment 2. FIG. 2 shows most preferred embodiment 2 having a protective housing 42 with a half-dodecagon shape, that gives it more strength and thereby allows manufacture of protective housing 42 with thinner walls and less material cost than would be required with alterative configurations such as that of a cylinder, while providing equivalent protection of float switch body 18 to the thicker walled configurations. The angled shape of the upper surface of protective housing 42 is also configured to minimize the accumulation of water and/or debris thereon. Further, although FIG. 2 shows protective housing 42 and rear part 6 having no surface texture, it is contemplated that any texture or decorative enhancement not interfering with its function may be used.

In contrast, FIG. 3 shows the most preferred embodiment 2 of the present invention having a two-part housing/clamp structure with a front part 4 and a rear part 6 joined together, with front part 4 positioned directly behind rear part 6 and little visible on front part 4 except a few centrally located vertically-extending ribs 22 each having ridged distal surface on the rearwardly facing surface 54 of front part 4. FIG. 3 further shows float switch body 18, shaft 26, and clip 20 extending downwardly slightly below front part 4. Front part 4 is routinely in contact with the inside wall surface of a condensate pan or other vertically-extending support surface (not shown), with the ends of the thumbscrews 8 that are remote from the oversized heads to contact with the opposed outside wall surface of the condensate pan or other support surface and bias it against front part 4. During routine use of preferred embodiment 2, rear part 6 does not touch the vertically-extending part of a condensate pan or other support surface. In addition, FIG. 3 shows three thumbscrews 8 extending through rear part 6 in a triangular configuration that permits secure attachment and fixed positioning of front part 4 and rear part 6 over the top edge of a support surface (not shown). While the number of thumbscrews 8 is not critical and more could be used, material cost and the benefit provided should be determining factors in deciding how many thumbscrews are to be used. The size and configuration of the thumbscrews is also not critical, although oversized head are preferred for easy hand manipulation by installers and maintenance personnel. Although not visible in FIG. 3, but shown in FIGS. 10 and 11, rear part 6 has two receptacles 30, one on each side of the upper thumbscrew 8, for receiving the bracing protrusions 32 of front part 4. FIG. 3 also shows lateral wings 36 adjacent to the two lower thumbscrews 8 that provide additional reinforcement to rear part 6 for reduced flexing that helps to maintain float switch body 18 in a needed level orientation for proper and reliable deployment during its use. The overall configuration of rear part 6 may be different from that shown in FIG. 3, including but not limited to dimensions that make it wider than front part 4 or longer than front part 4.

Figure 4:
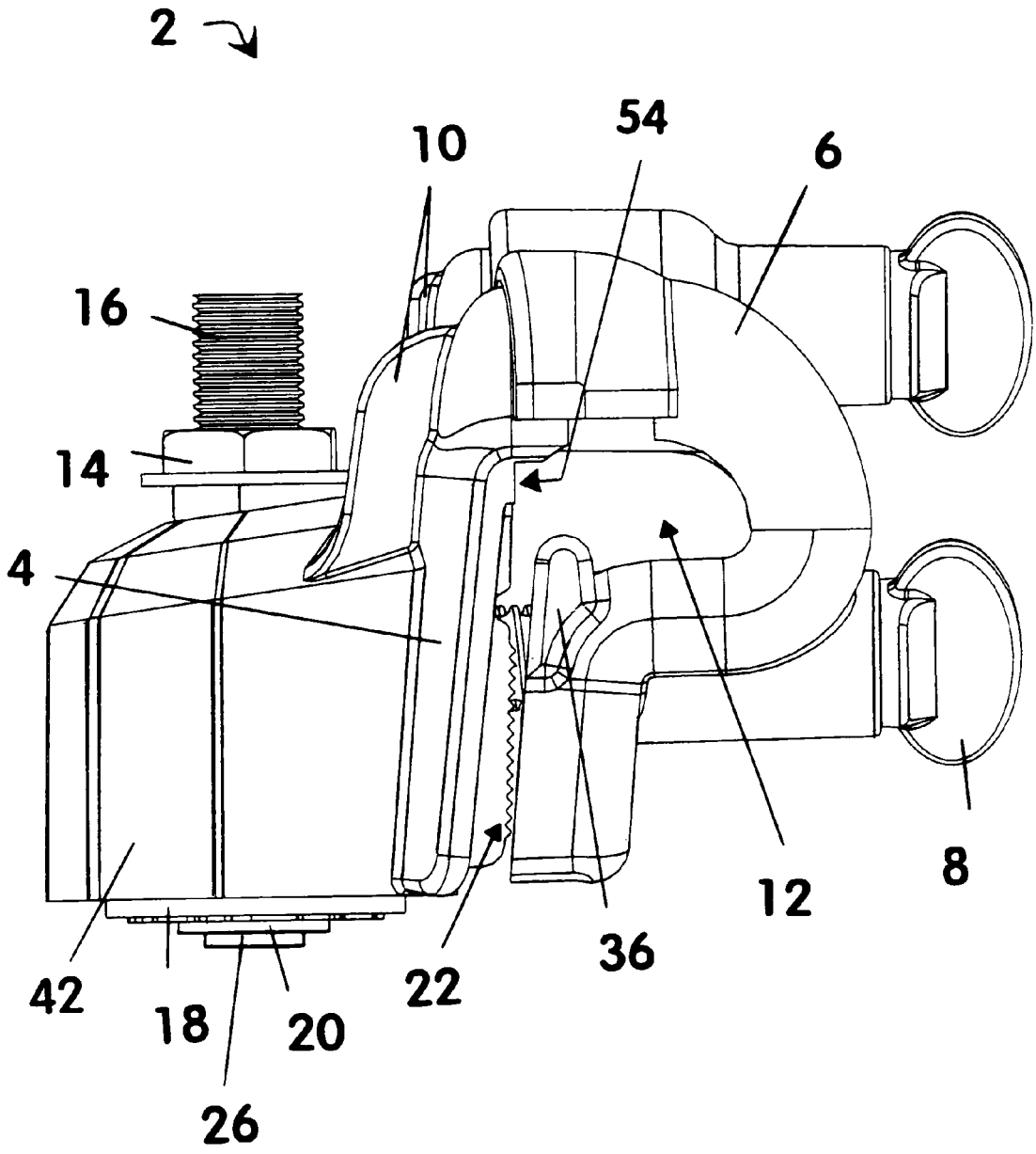
FIG. 4 is side view of the most preferred embodiment of the present invention revealing an inverted J-shaped slot between the front and rear parts of the two-part housing/clamp structure configured for condensate pan wall insertion, the threaded upper end of a float body guiding shaft extending upwardly and centrally through the protective float housing, the float switch body, clip, and shaft bottom exposed below the lower edge of the float housing, external braces/ribs upwardly depending from the top of the float housing, the endmost one of multiple internal ribs each having a ridged distal surface present on the lower rear surface of the front part of the two-part housing/clamp structure, and multiple thumbscrews that hold together the front and rear parts of the housing/clamp structure.

FIG. 4 shows the inverted J-shaped slot 12 formed when front part 4 and rear part 6 are joined together. The planar rear surface 54 of front part 4 is easily adaptable to metal and plastic condensate pans (not shown). Braces/ribs 10 provide strengthening and anti-flexing structure between protective housing 42 and the remaining portion of front part 4. The wing 36 laterally on rear part 6 and adjacent to inverted J-shaped slot 12 also provides strengthening and anti-flexing structure. Although hidden from view in FIG. 4, a second wing 36 is positioned in a mirror image location on the opposing side of rear part 6. The endmost rib 22 shown in FIG. 4, in combination with the other ribs 22 (See FIG. 9) behind it that are hidden from view, provide a horizontally ridged gripping surface against which the wall of a condensate collection pan or other support surface positioned within inverted J-shaped slot 12 can be secured by the lower thumbscrews 8 tightened through rear part 6. The upper thumbscrew 8 does not touch the pan wall or other support surface inserted into inverted J-shaped slot 12. No drilling of a hole in upper portion of a condensate collection pan or other support surface 30 is required during installation or use of preferred embodiment 2. Instead, upper thumbscrew 8 is received into a threaded opening 34 in front part 4, that is located above inverted J-shaped slot 12. The notches 38 and spaces between ribs 22 (shown in FIG. 9) provide air venting assistance in airlock malfunction prevention when float switch body 18 attempts its vertical deployment. Although FIG. 4 shows inverted J-shaped slot 12 having an enlarged upper area, its dimension and configuration are not critical as long as they can accommodate the upper edge configuration on the types of pan walls or other support surfaces contemplated for use therewith. In contrast, the configuration and proportional dimensions shown in FIG. 4 for inverted J-shaped slot 12 work to accommodate all of the multiple pan types and sizes in current use today air conditioning applications, so that an installer does not have to bear the inventory expense of carrying multiple switches for differing applications. Although one lower thumbscrew 8 is hidden in FIG. 4, in most preferred embodiment 2 it is preferred for three thumbscrews 8 to be used, even though the number used is not critical. When only three thumbscrews 8 are present, most preferred embodiment 2 can be installed in as little as ten seconds. For simple operation, ease of use, and reduced material cost, thumbscrews 8 are positioned to extend through rear part 6 in a substantially horizontally-extending orientation. This also helps to provide further anti-flexing structure. A disk-shaped stop/clip 20, as well as the bottommost portions of a shaft 26 and a float switch body 18 are visible in FIG. 4, extending below protective housing 42. The length of protective housing 42 is not critical, however, protective housing 42 should substantially cover float switch body 18 to protect it against debris (not shown) that could cause a deployment malfunction. In addition, FIG. 4 shows the half-dodecagon configuration of protective housing 42, which provides equivalent strength to cylindrical housings (not shown) for less material cost, and the upper threaded portion 16 of a shaft 26 that is centrally positioned within protective housing 42 and secured by a lock-nut 14. Also in FIG. 4, the manipulated ends of the thumbscrews 8 appear large relative to rear part 6, with the large/oversized configuration shown being preferred to facilitate ease of use. It is not contemplated for the number of thumbscrews 8 in preferred embodiment 2 be limited to that shown in FIG. 4. Further, although the half-dodecagon configuration is preferred, protective housing 42 may have any cross-sectional configuration as long as that of float switch body 18 complements it for unimpaired vertical movement according to rising water levels in an associated condensate collection pan.

Figure 5:
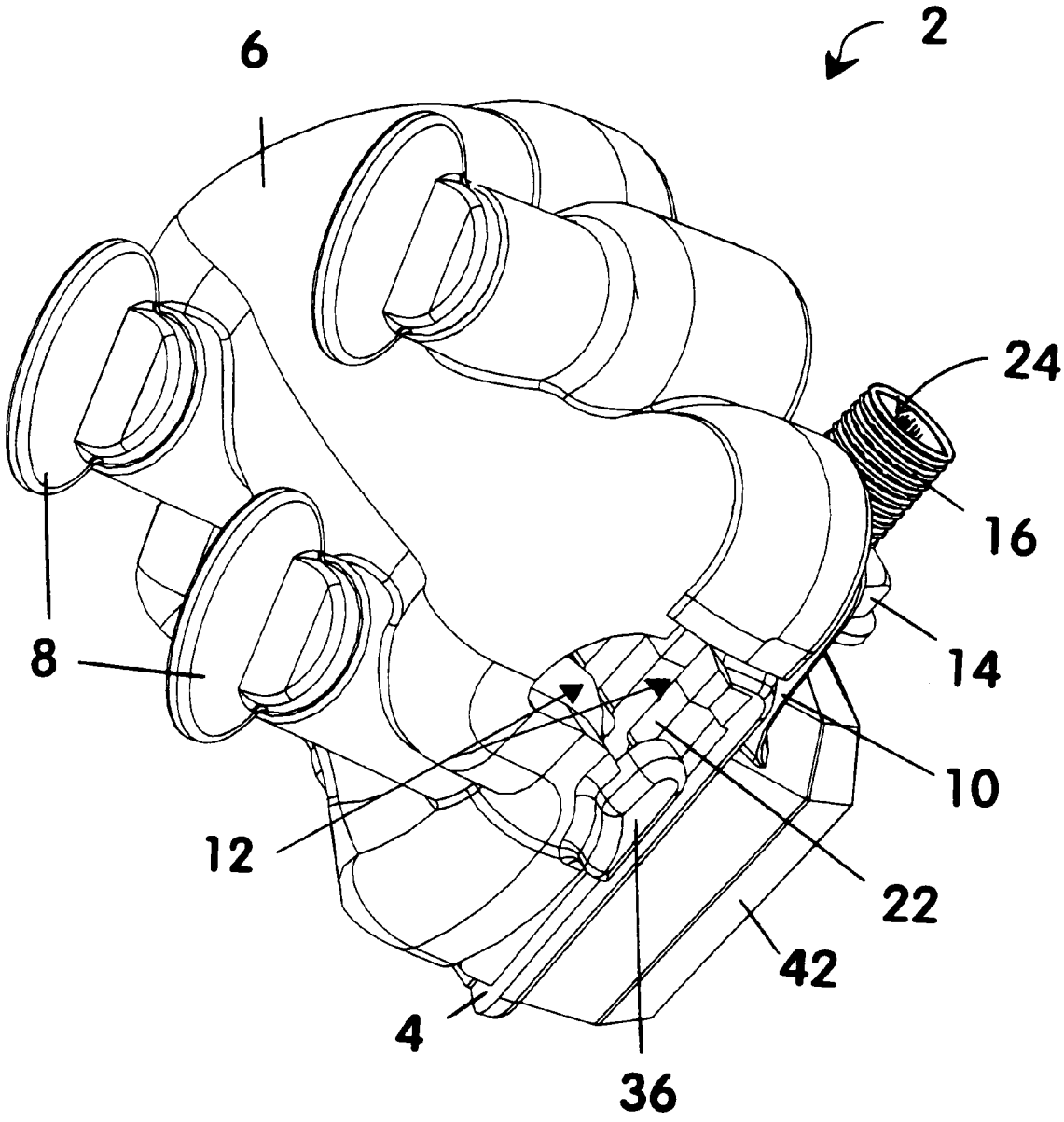
FIG. 5 is a rear perspective view of the most preferred embodiment of the present invention having a two-part housing/clamp structure, a float body guiding shaft in its usable position through the top of the front part of the housing/clamp structure, and three thumbscrews extending through the rear part of the housing/clamp structure, with the lower two thumbscrew providing direct engagement with the outside surface of a condensate pan wall or other vertically-extending support structure upon which the housing/clamp structure is secured during its use.
Figure 6:
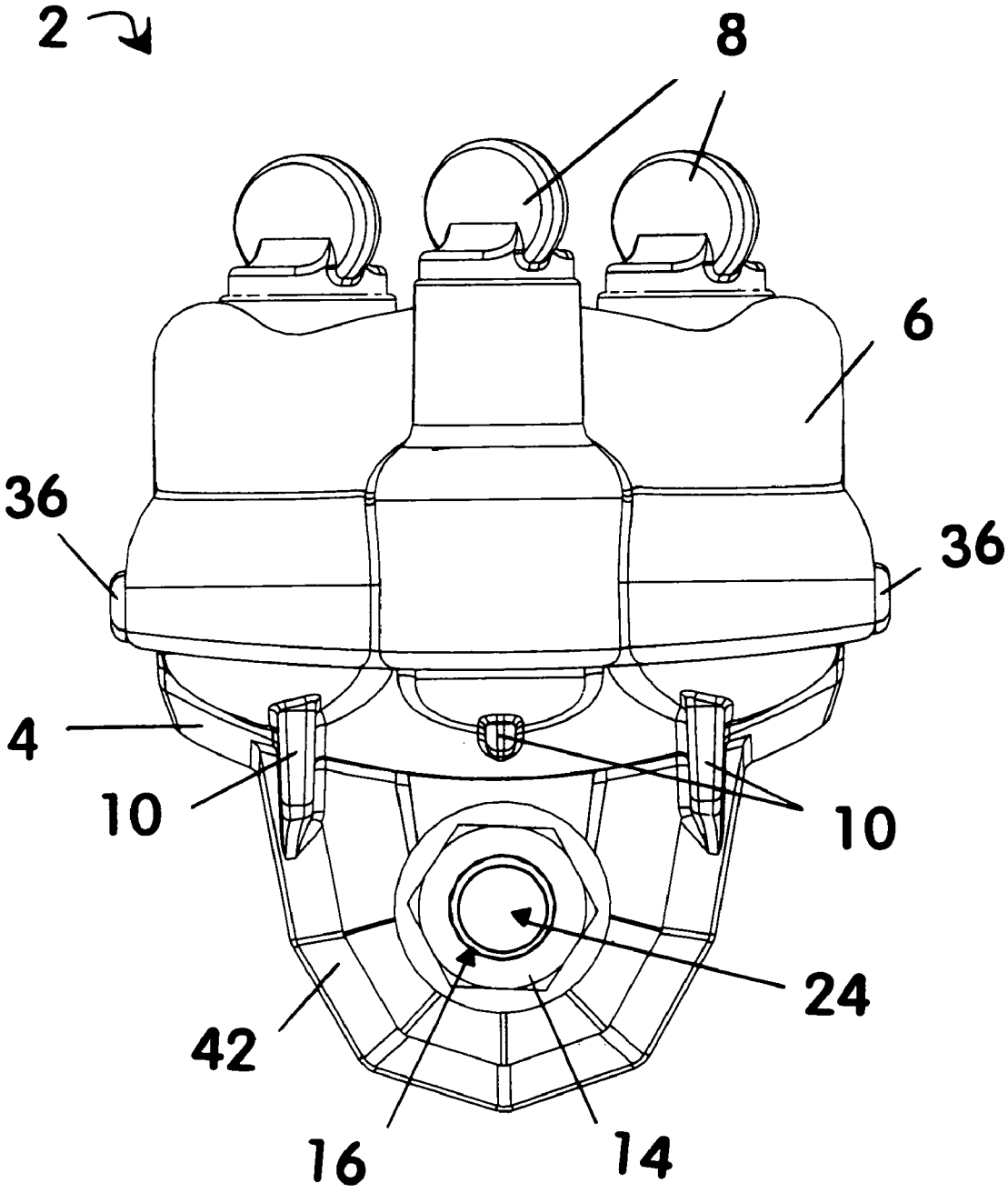
FIG. 6 is a top view of the most preferred embodiment of the present invention having a two-part housing/clamp structure, a float body guiding shaft in its usable central position through the top of the float housing in the front part of the housing/clamp structure, three upwardly extending braces/ribs strengthening the front part of the housing/clamp structure, laterally-extending wings on the back part of the housing/clamp structure, and three thumbscrews extending through the rear part of the housing/clamp structure, with interior ends of the lower two thumbscrew providing direct engagement with the outside surface of a condensate pan or other vertically-extending support structure upon which the housing/clamp structure is secured during its use.

FIG. 5 shows more detail in the structure of rear part 6 in the most preferred embodiment 2 of the present invention and the ribs 22 on the rearwardly facing surface 54 of front part 4 that form a portion of the perimeter of the inverted J-shaped slot 12. A strengthening wing 36 is also positioned on rear part 6 adjacent to the inverted J-shaped slot 12. The upper portions of the ribs 22 shown do not have a ridged configuration. For a comparison of the preferred relative positioning of the ridged and non-ridged portions of ribs 22, see FIGS. 3 and 9. Most preferred embodiment 2 has a two-part housing/clamp structure in which front part 4 is completely separable from rear part 6 for installation, inspection, and maintenance purposes. FIG. 5 shows three thumbscrews 8 in a substantially triangular configuration, with two lower thumbscrews 8 extending toward front part 4 and inverted J-shaped slot 12, and one upper thumbscrew 8 positioned near the top surfaces of front part 4 and rear part 6 to secure them together. In contrast, the lower thumbscrews 8 do not secure front part 4 and rear part 6 together. Instead, the two lower thumbscrews 8 engage the outside surface of a condensate collection pan wall, or other container or support surface (not shown), and bias it toward front part 4. FIG. 5 further shows the upper threaded portion 16 of shaft 26 in its usable position through the top of protective housing 42 and fixed therein via a lock-nut 14. The upper opening 24 in shaft 26 allows the insertion of electrical wiring 50, shown in FIG. 12, for the sending of an electrical signal to an associated fluid producing system when the amount of collected fluid therefrom exceeds a pre-established safe threshold level. FIGS. 5 and 6 further show protective housing 42 substantially covering the float switch body 18 inside it, to keep airborne debris (not shown) from preventing the proper and uninhibited vertical movement of float switch body 18. The stop/clip 20 and the shaft 26 to which stop 20 is attached are not visible below protective housing 42. As shown in Fig. The disk-shaped stop/clip 20 is secured near to the lower end of shaft 26 in a groove 48. The lock-nut 14 positioned within protective housing 42, in addition to assisting in the secure fixing of shaft 26 within protective housing 42, can be used as a means of adjusting the maximum vertical displacement of float switch body 18 according to a specific application or need. When the upper portion of a fluid collection pan or other upstanding support surface is inserted into the inverted J-shaped slot between front part 4 and rear part 6 and the upper thumbscrew 8 is tightened, the two lower thumbscrews 8 are each advanced toward the outside wall of the support surface until they each firmly engage it. Thumbscrews 8 should not be over tightened.

FIGS. 6 and 7 respectively show top and bottom views of the most preferred embodiment 2 of the present invention. FIGS. 6 and 7 both show a two-part housing/clamp structure with front part 4 and rear part 6, with three thumbscrews extending through rear part 6. Rear part 6 also has opposed lateral wings 36 that provide strengthening and anti-flexing structure. In addition and apart from FIG. 7, FIG. 6 shows several braces/ribs 10 located between protective housing 42 and the remaining portion of front part 6 for strengthening and anti-flexing purposes. However, no air venting hole 28 is visible through the top surface of protective housing 42 or front part 4. Instead, air venting to prevent airlock malfunction of float switch body 18 during its deployment is accomplished through the joint rear surface 54 of protective housing 42 and front part 4, with the air replaced by fluid entering protective housing 42 through its bottom opening able to escape through protected air vent openings 28, shown in FIG. 8 and into the inverted J-shaped slot 12. In their protective positions which have fluid communication with inverted J-shaped slot 12, air vent openings 28 are substantially protected from clogging via air borne and other debris. FIG. 6 also shows the upper threaded position 16 of shaft 26 fixed into its usable position through the top of protective housing 42 via lock-nut 14. The upper opening 24 in shaft 26 allowing the insertion of electrical wiring 50, shown in FIG. 12, that is used for electrical connection of preferred embodiment 2 to an associated fluid producing unit or system. Further, in FIG. 6 rear part 6 appears slightly wider in dimension than front part 4, however, such relative dimension is not critical. Also, although the present invention structure shown in FIG. 6 is most preferred, it is contemplated for cosmetic departure from the appearances of front part 4 and rear part 6, as shown in FIG. 6, to also be within the scope of the present invention. In contrast, FIG. 7 shows float switch body 18 concentrically positioned around shaft 26 and fixed thereupon by a removable stop/clip 20. Float switch body 18 substantially fills protective housing 42 and it is preferred that the words 'bottom' and/or 'top' are appropriately marked thereon for proper directional association with shaft 26. Float switch body 18 is large and highly buoyant, allowing it to shut off fluid production in response to a very small amount of fluid collection. To provide additional clearance for uninhibited vertical deployment of float switch body 18, front part 4 can include a volume expanding indentation 52. FIG. 7 also shows multiple ribs 22 attached to rear surface 54 that provide gripping ridges for non-slip connection of front part 4 and rear part 6 to a support surface (not shown). Further, venting spaces 56 between adjacent ribs 22 enhance the air flow needed to prevent airlock malfunction of float switch body 18 during its deployment as fluid enters protective housing 42 through its open bottom end. The half decagon-shaped protective housing 42 shown in FIG. 7 lowers material cost while providing equivalent material strength over cylindrical housings of similar size. The number of thumbscrews 8 used is not critical. Also, thumbscrews 8 are not limited in size, shape, location, or surface texture, and as long as they are easily gripped and manipulated for prompt installation of preferred embodiment 2 to a support structure, any desired size, shape, location, and surface texture can be used. However, in determining the size, number, shape, location, and/or surface texture of thumbscrews 8, as in all aspects of present invention structure and design, it is preferred that the material cost relating thereto only be increased where additional benefit is derived.

FIGS. 8 and 9 are back views of the front part 4 of the two-part housing/clamp structure of preferred embodiment 2, with multiple closely spaced-apart and vertically-extending ribs 22 on its rear surface 54 each having a notch 38 at approximately the same height to form an air venting channel. Each rib 22 also preferably has a ridged distal surface below its notch 38. Further, as shown in FIG. 9, two spaced-apart air vent openings 28 are located through the back wall of front part 4 between ribs 22 and in fluid communication with the notches 38 forming an air venting channel. Thus, excess air created within protective housing 42 by fluid rising through its open bottom end, is allowed to escape into inverted J-shaped slot 12 via air vent openings 28. The size, number, spacing, and shape of air vent openings 28 would also be determined according to the needed application, and may be different from that shown in FIG. 9. FIGS. 8 and 9 further show two spaced-apart lateral bracing protrusions 32 and a threaded opening 34 centrally between bracing protrusions 32 for engagement with the upper thumbscrew 8. The relative diameter dimensions of bracing protrusions 32 and threaded opening 34 could be different from that shown. While upper thumbscrew 8 connects with threaded opening 34 and provides a threaded connection between the upper portions of front part 4 and rear part 6, upper thumbscrew 8 and bracing protrusions all contribute to a strengthened and anti-flexing connection between front part 4 and rear part 6 over the top edge of a support structure (not shown). Protective housing 42 is shown in broken lines in FIG. 8 to show its relative location to threaded opening 34 and bracing protrusions 32. FIGS. 8 and 9 also show float switch body 18, the lower end of shaft 26, and stop/clip 20 all extending below front part 4, although not critical. In addition, FIG. 9 shows upper threaded portion 16 of shaft 26 secured through centrally through the sloped top surface of protective housing 42 via a lock-nut 14 and a brace/rib 10 strengthening and providing and anti-flexing connection between protective housing 42 and the remaining portion of front part 4. It is possible for other embodiments of the present invention to have a front part 4 with a more rounded or oval cross-sectional configuration, a more rounded top configuration, and/or other cosmetic variation that does not significantly diminish its function. Further, the number, configuration, size, spacing, surface structure, and coverage of vertically-extending internal ribs 22 can be different than that shown in FIGS. 8 and 9, and would be determined according to the strength requirements appropriate to the needed application.

Figure 10:
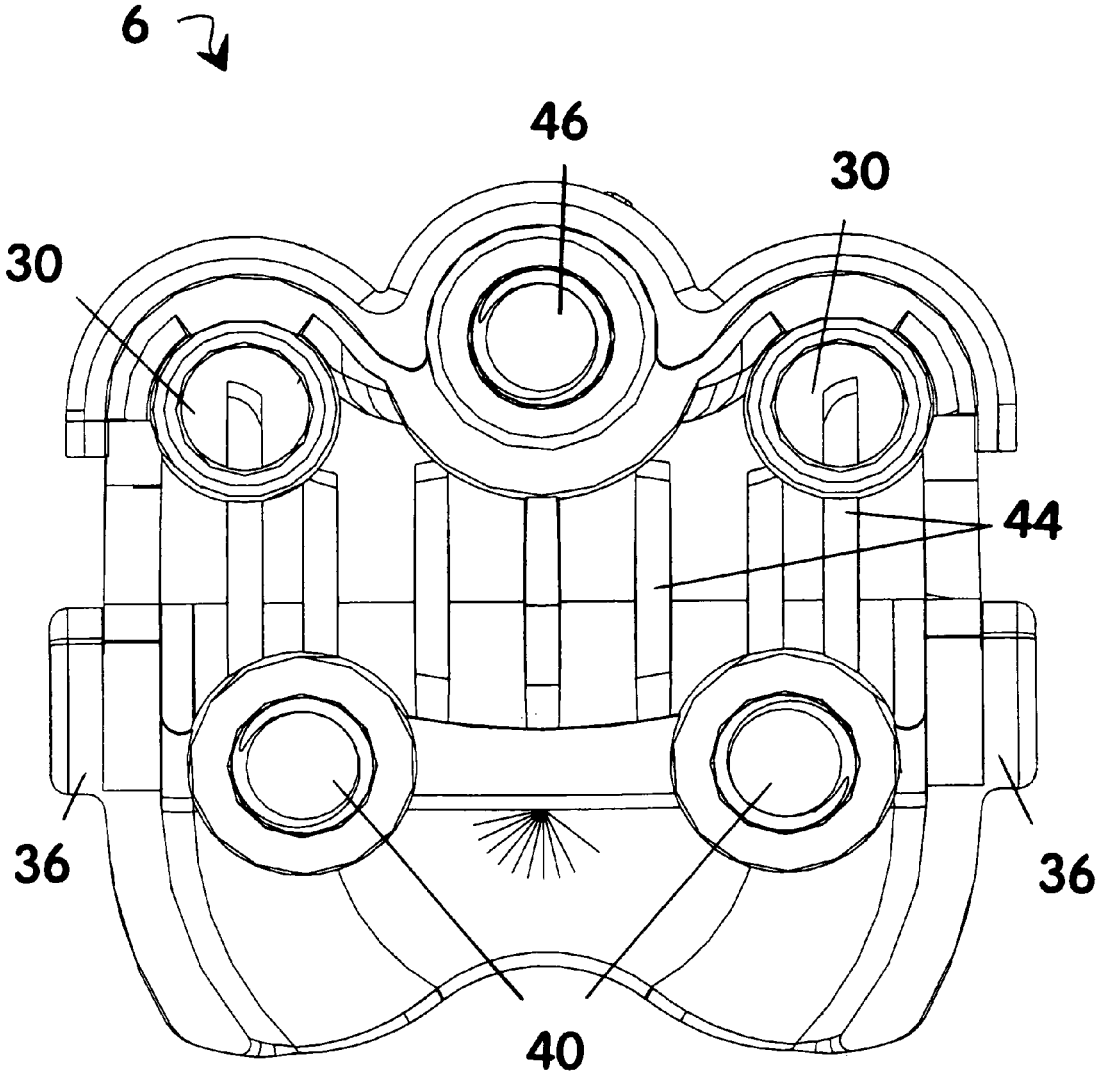
FIG. 10 is a front view of the interior surface of the rear part of the two-part housing/clamp structure in the most preferred embodiment of the present invention having three openings for thumbscrews, multiple vertically-extending ribs, and two non-threaded openings formed laterally on opposing sides of the upper central opening for engagement with the bracing protrusions on the front part of the housing/clamp structure.
Figure 11:
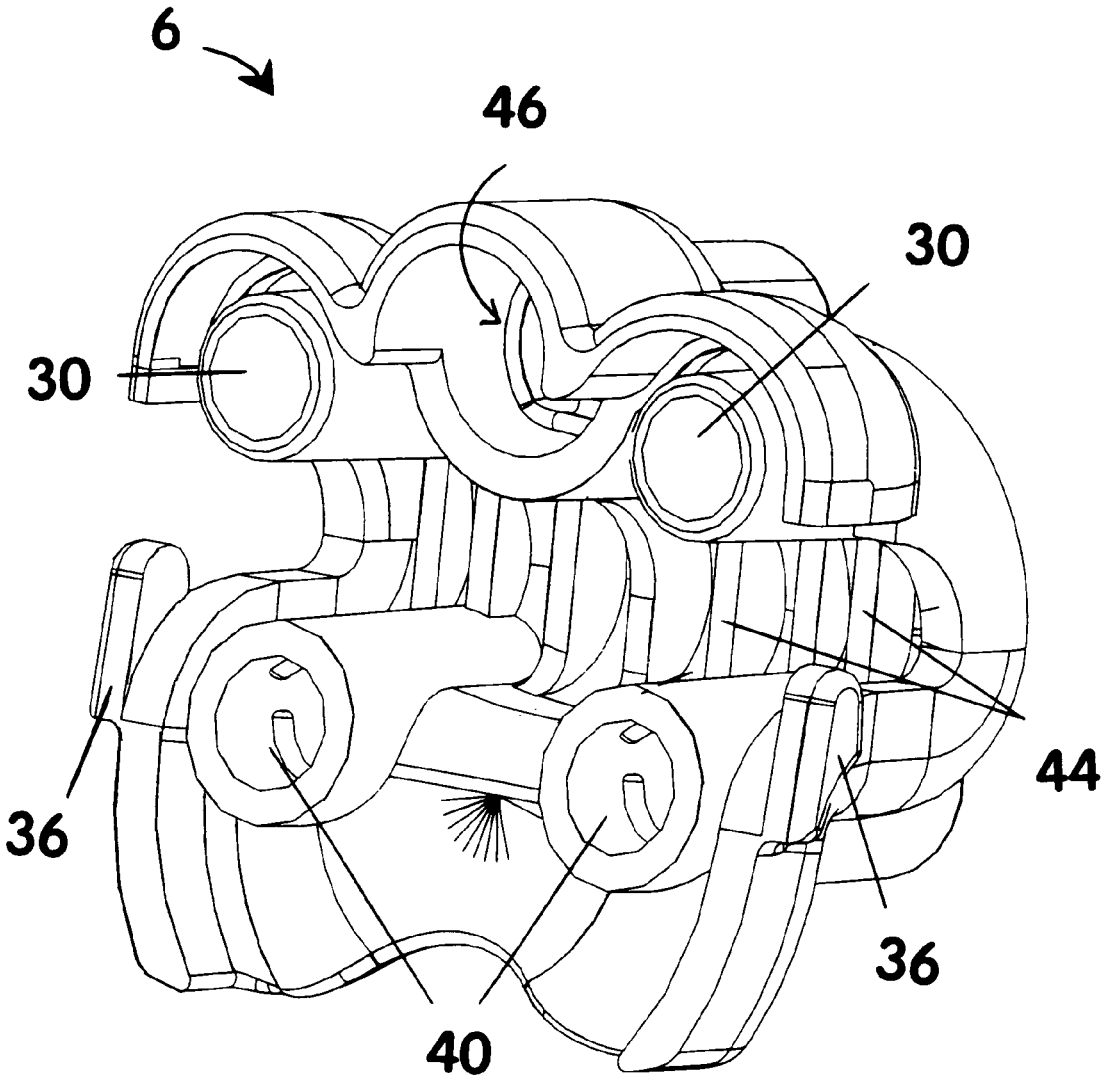
FIG. 11 is a perspective view of the rear part of the two-part housing/clamp structure in the most preferred embodiment of the present invention revealing an upper and preferably non-threaded central opening configured for easy pass-through insertion of the central non-threaded portion of a thumbscrew, two lower threaded openings for support of thumbscrews needed to engage the external surface of a vertically-extending wall of a condensate collection pan or other support structure, multiple vertically-extending ribs in the area forming the closed end of the inverted J-shaped slot that provide airlock-avoiding channels therebetween, and two upper non-threaded openings each laterally positioned on a different side of the upper central opening for engagement with one of the bracing protrusions on the front part of the housing/clamp structure.

FIGS. 10 and 11 are front views of the interior surface of the rear part 6 of the two-part housing/clamp structure in the most preferred embodiment 2 of the present invention. FIGS. 10 and 11 show rear part 6 having opposed lateral wings 36, one upper pass-through opening 46 for upper thumbscrew 8, two lower threaded openings 40 for thumbscrew 8 insertion, multiple strength-enhancing and vertically-extending non-ridged ribs 44 in the area forming the closed end of J-shaped slot 12 that have elongated spaces 56 between them that also assist in air venting and the prevention of airlock malfunction of float switch body 18, and with rear part 6 also having two non-threaded receptacles 30 laterally on opposing sides of pass-through opening 46 for engagement with the bracing protrusions 32 on front part 4. Pass-through opening 46 and threaded openings 40 form a generally triangular configuration. Additional openings 40 or 46 for thumbscrews 8 may also be formed through rear part 6, as needed for specific applications. Although it is preferred for pass-through opening 46 to be non-threaded and only slightly larger than upper thumbscrew 8, neither is critical and a threaded configuration is also considered to be within the scope of the present invention. However, a non-threaded configuration for pass-through opening 46 would provide for faster installation, and if pass-through opening 46 is too large, a secure connection between front part 4 and rear part 6 may be compromised. Non-threaded receptacles 30 should also be dimensioned to closely fit around bracing protrusions 32 for strength enhancing and anti-flexing connection of front part 4 to rear part 6. It is possible for other embodiments of the present invention to have a rear part 6 with a more rounded or oval cross-sectional configuration, a more rounded top configuration, differing wing 36 configurations, number, or dimension, and/or other cosmetic variations to any component or surface that does not significantly diminish its function. Further, the number, configuration, size, spacing, surface structure, and coverage of non-ridged internal ribs 44 can be different than that shown in FIGS. 10 and 11, and would be determined according to the strength and air venting requirements appropriate to the needed application.

FIG. 12 shows the float switch assembly in the most preferred embodiment 2 of the present invention having two lock-nuts 14 secured to the upper threaded portion 16 of a shaft 26. Lock-nuts 12 are used to secure shaft 26 centrally within protective housing 42. When the upper threaded portion 16 of shaft 26 is inserted through a threaded opening (not shown) in protective housing 42, one lock-nut 14 is secured to upper threaded portion 16 within protective housing 42 and the other lock-nut 14 becomes secured to upper threaded portion 16 outside of protective housing 42. Further, when float switch body 18 is concentrically positioned around shaft 26 for free longitudinal movement along shaft 26 and so that shaft 26 can be used as a guide for float switch body 18 during its up and down movement in response to changing water levels in an associated condensate pan or other container or support surface, and a disk-shaped stop/clip 20 is attached to the bottom end of shaft 26 in groove 48, the stop/clip 20 and the lower lock-nut 14 that is inside protective housing 42 then define the limits of vertical movement for float switch body 18. It is contemplated for float switch body 18 to be wide, very buoyant, and substantially fill the interior of protective housing 42 for responsive and reliable operation.

The materials from which the most preferred embodiment 2 is made can vary, but must be impervious to corrosion and pest-resistant. Preferably for cost considerations, although not limited thereto, it is contemplated for protective housing 42, float switch body 18, stop/clip 20, rear part 6, thumbscrews 8, shaft 26, and lock-nuts 14 to all be made from plastic. Resistance to UV radiation is not necessarily a contemplated feature of the present invention, unless dictated by the application. Manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Although size of the present invention is not critical, for many condensate collection applications, the length, width, and height dimensions of the combined protective housing 42 and rear part 6 would be less than three inches, and in some applications the width, height, and depth dimensions of protective housing 42 would not exceed than one-and-one-half inches.

Prior to use of the most preferred embodiment of the present invention, float switch body 18 would be positioned on shaft 26 so that electrical wiring 50 extends through top end 32. Preferably, the upper threaded portion 16 of shaft 26 would then be inserted through a threaded opening (not shown) in the top end of protective housing 42, and secured in a usable position within the top surface of protective housing 42 via two lock-nuts 14 so that the remainder of shaft 26 is vertically extending through protective housing 42 with float switch body 18 substantially filling the interior space therein. Stop/clip 20 would be fixed to the bottom end of shaft 26, preferably in a groove 48, to define the lower boundary of float switch body 18 movement vertically along shaft 26 during use. Coarse adjustment of the needed vertical displacement of float switch body 18 would be accomplished by repositioning lock-nuts 14 on shaft 26. Protective housing 42 may completely, or only substantially, cover float switch body 18. To facilitate installation, it is contemplated that thumbscrews 8 would already be attached to rear part 6. Thus, it is contemplated that all an operator/installer would have to do is loosen the upper thumbscrew 8 and place rear part 6 against the outside surface of a condensate collection pan or other support member (not shown), place front part 4 against the inside surface of the same condensate collection pan or support member, insert bracing protrusions 32 into receptacles 30, and then tighten upper thumbscrew 8 into upper threaded opening 34 in front part 4 and the lower thumbscrews 8 into lower threaded openings 40 until the condensate collection pan or support member is securely biased against front part 4 without thumbscrews 8 being over tightened. No drilling of holes through the upstanding wall of the condensate collection pan or other support surface is required. Should an application dictate a higher or lower fluid collection threshold than factory set during manufacture, the lock-nuts 14 can be loosened on the upper threaded portion 16 of shaft 26 to raise or lower the amount of vertical movement through which float switch body must become deployed for shut-off signal activation. To increase float switch body 18 sensitivity so that less fluid collection will cause a shut-off signal transmission, only the top lock-nut 14 needs to be loosened, followed by a downward threading of shaft 26 through the top surface of protective housing 42, with float switch body 18 being extended beyond the lower edge of protective housing 42, as needed. Once protective housing 42 is in its secured and usable position, the installer or operator would check it for the stable and level positioning required for reliable and uninhibited vertical movement of float switch body 18. Electrical wiring 50 would then be connected to the system providing water or other fluid to the collection pan or other support structure associated with the present invention. Then, when collected fluid fills the collection pan or container beyond a pre-determined depth that is considered to be safe to prevent overflow or back-up, the present invention float switch body 18 is lifted by the rising fluid within protective housing 42 that enters it through its open bottom end, to the height that interrupts the fluid-producing system's operation and stops additional collection of fluid in the pan or other support surface associated with the present invention. As fluid rises in protective housing 42, the air vent openings 28 through the rear surface 54 of protective housing 42 prevent the creation of an airlock that could potentially interfere with the proper vertical movement of float switch body 18. Minimal maintenance is contemplated. Protective housing 42 would protect the movement of float switch body 18 from interference due to airborne and other debris (not shown), such as the fibers found in attic insulation. If protective housing 42 is made from translucent, transparent, or partially transparent materials, an operator could visibly assess the effective operation of float switch body 18 without removing it from protective housing 42 or separating rear part 6 and front part 4 from the upstanding wall of a collection pan or other support surface. The size, configuration, and pattern of air vent openings 28 and thumbscrews 8 are not critical and can vary depending upon design and price point considerations, such as but not limited to ease of manufacture and effectiveness of operation. It is further contemplated for protective housing 42, front part 4, rear part 6, and thumbscrews 8 to have a compact design and construction for efficient packaging and transport.

I claim:

1. A float switch assembly for use in association with a fluid collection container having a top edge to shut off the system providing fluid to the container once a pre-determined fluid depth has been reached, said assembly comprising:

at least three threaded fasteners;

a front part and a rear part configured and dimensioned for forming an inverted J-shaped slot therebetween when joined together with said fasteners;

said front part having a protective housing with a top surface and an open bottom end, said front part also having a rear surface, at least one air vent opening through said rear surface, a plurality of front ribs that are substantially vertically-extending and rearwardly depending from said rear surface and which form a part of said inverted J-shaped slot, at least two spaced-apart laterally positioned and rearwardly-extending bracing protrusions, and an upper threaded opening centrally positioned between said bracing protrusions, said upper threaded opening configured and dimensioned for secure engagement with one of said threaded fasteners;

said rear part having at least two lower threaded openings each dimensioned for secure engagement with one of said threaded fasteners, two spaced-apart receptacles each laterally positioned and dimensioned to receive one of said bracing protrusions, an upper pass-through opening that is positioned centrally to said receptacles and dimensioned for insertion therethrough of one of said threaded fasteners, and a plurality of rear ribs that form a part of said inverted J-shaped slot;

a shaft with an upper threaded portion secured within said top surface of said protective housing, said shaft also having a bottom end with a stop;

a float switch body concentric with said shaft and positioned for free movement along said shaft; and fastening means adapted for securely attaching said shaft to said housing so that when electrical wiring is connected between said float switch body and the system providing fluid to the collection container with which said assembly is associated, and when the top edge of the collection container is positioned within said J-shaped slot, said fasteners fixedly secure said front part to said rear part for level positioning of said float switch body and free movement along said shaft between said stop and said fastening means in response rising and falling fluid levels in the attached container, and whereby when a pre-determined maximum desired depth of fluid accumulation is reached in said attached container, said float switch body shuts off the system, with airlock malfunction being averted by said at least one air vent opening and said front and rear ribs.

2. The assembly of claim 1 wherein said fastening means comprises at least one lock-nut.

3. The assembly of claim 1 wherein said stop is separable from said shaft.

4. The assembly of claim 1 wherein said shaft has a groove near said bottom end and said stop is used in said groove.

5. The assembly of claim 1 wherein said shaft has a top opening configured and dimensioned for insertion therethrough of electrical wiring.

6. The assembly of claim 1 wherein the maximum vertical movement of said float switch body along said shaft is adjustable.

7. The assembly of claim 1 wherein said front part further comprises a plurality of external reinforcing members configured and dimensioned to reduce flexing of said front part and said rear part when joined together, said external reinforcing members being selected from a group consisting of braces and ribs.

8. The assembly of claim 7 wherein said external reinforcing members depend upwardly from said protective housing.

9. The assembly of claim 1 wherein said rear part further comprises a plurality of lateral wings adjacent to said slot.

10. The assembly of claim 1 wherein said protective housing has a half-dodecagon configuration.

11. The assembly of claim 1 wherein said top surface of said protective housing is sloping.

12. The assembly of claim 1 wherein said protective housing has a half-dodecagon configuration and said top surface of said protective housing is sloping.

13. The assembly of claim 1 wherein said at least three fasteners are thumbscrews.

14. The assembly of claim 13 wherein said thumbscrews have oversized heads configured for fast and easy hand manipulation.

15. The assembly of claim 1 wherein said front ribs have distal surfaces with a notch.

16. The assembly of claim 15 wherein said distal surfaces of said front ribs further comprise ridges.

17. The assembly of claim 1 wherein said rear ribs are non-notched.

18. The assembly of claim 1 wherein said bottom end of said shaft, said stop, and said float switch body are configured and positioned to extend below said protective housing.

19. A float switch assembly for use in association with a fluid collection container having a top edge to shut off the system providing fluid to the container once a pre-determined fluid depth has been reached, said assembly comprising:

at least three thumbscrews;

a front part and a rear part configured and dimensioned for forming an inverted J-shaped slot therebetween when joined together with said thumbscrews;

said front part having a protective housing with a top surface and an open bottom end, said front part also having a rear surface, at least one air vent opening through said rear surface, a plurality of notched ribs that are substantially vertically-extending and rearwardly depending from said rear surface that form a part of said inverted J-shaped slot, at least two spaced-apart laterally positioned and rearwardly-extending bracing protrusions, and an upper threaded opening centrally positioned between said bracing protrusions, said upper threaded opening configured and dimensioned for secure engagement with one of said threaded fasteners;

said rear part having at least two lower threaded openings each dimensioned for secure engagement with one of said threaded fasteners, two spaced-apart receptacles each laterally positioned and dimensioned to receive one of said bracing protrusions, an upper pass-through opening that is positioned centrally to said receptacles and dimensioned for insertion therethrough of one of said threaded fasteners, and a plurality of non-ridged internal ribs that form a part of said inverted J-shaped slot;

a shaft with an upper threaded portion secured within said top surface of said protective housing, said shaft also having a bottom end with a stop;

a float switch body concentric with said shaft and positioned for free movement along said shaft; and fastening means adapted for securely attaching said shaft to said housing so that when electrical wiring is connected between said float switch body and the system providing fluid to the collection container with which said assembly is associated, and when the top edge of the collection container is positioned within said J-shaped slot, said fasteners fixedly secure said front part to said rear part for level positioning of said float switch body and free movement along said shaft between said stop and said fastening means in response rising and falling fluid levels in the attached container, and whereby when a pre-determined maximum desired depth of fluid accumulation is reached in said attached container, said float switch body shuts off the system.

20. The assembly of claim 1 wherein said notched ribs further comprise a ridged configuration facing said inverted J-shaped slot.

* * * * *